US005195614A

United States Patent [19]

Hornyack et al.

[11] Patent Number: 5,195,614

[45] Date of Patent: Mar. 23, 1993

[54] HYDRAULIC CUSHIONRIDE ELEVATOR

[75] Inventors: John Hornyack, Tolland; Louis Bialy, Simsbury; Rajendra V. Mistry, Farmington, all of Conn.

[73] Assignee: Otis Elevator Company, Farmington, Conn.

[21] Appl. No.: 764,438

[22] Filed: Sep. 23, 1991

[51] Int. Cl.[5] ..... B66B 11/04

[52] U.S. Cl. ..... 187/17; 187/68

[58] Field of Search ..... 187/17, 67, 68, 36, 187/1 R

[56] References Cited

U.S. PATENT DOCUMENTS

| | | | |
|---|---|---|---|
| 5,556 | 8/1873 | Hope | 187/36 |
| 952,097 | 3/1910 | Brown | 187/67 |
| 3,043,401 | 7/1962 | Hallene et al. | 187/17 |

*Primary Examiner*—Robert P. Olszewski
*Assistant Examiner*—Kenneth Noland
*Attorney, Agent, or Firm*—Lloyd D. Doigan

[57] ABSTRACT

A mechanism is placed between a plunger and an elevator car to damp the effects of stick-slip encountered during elevator start-up and to minimize the probability of damage to a plunger/cylinder assembly if the elevator car is stopped in an emergency. The mechanism comprises a self-leveling hydraulic shock absorber that operates independently of any stick-slip between the plunger and cylinder.

13 Claims, 1 Drawing Sheet

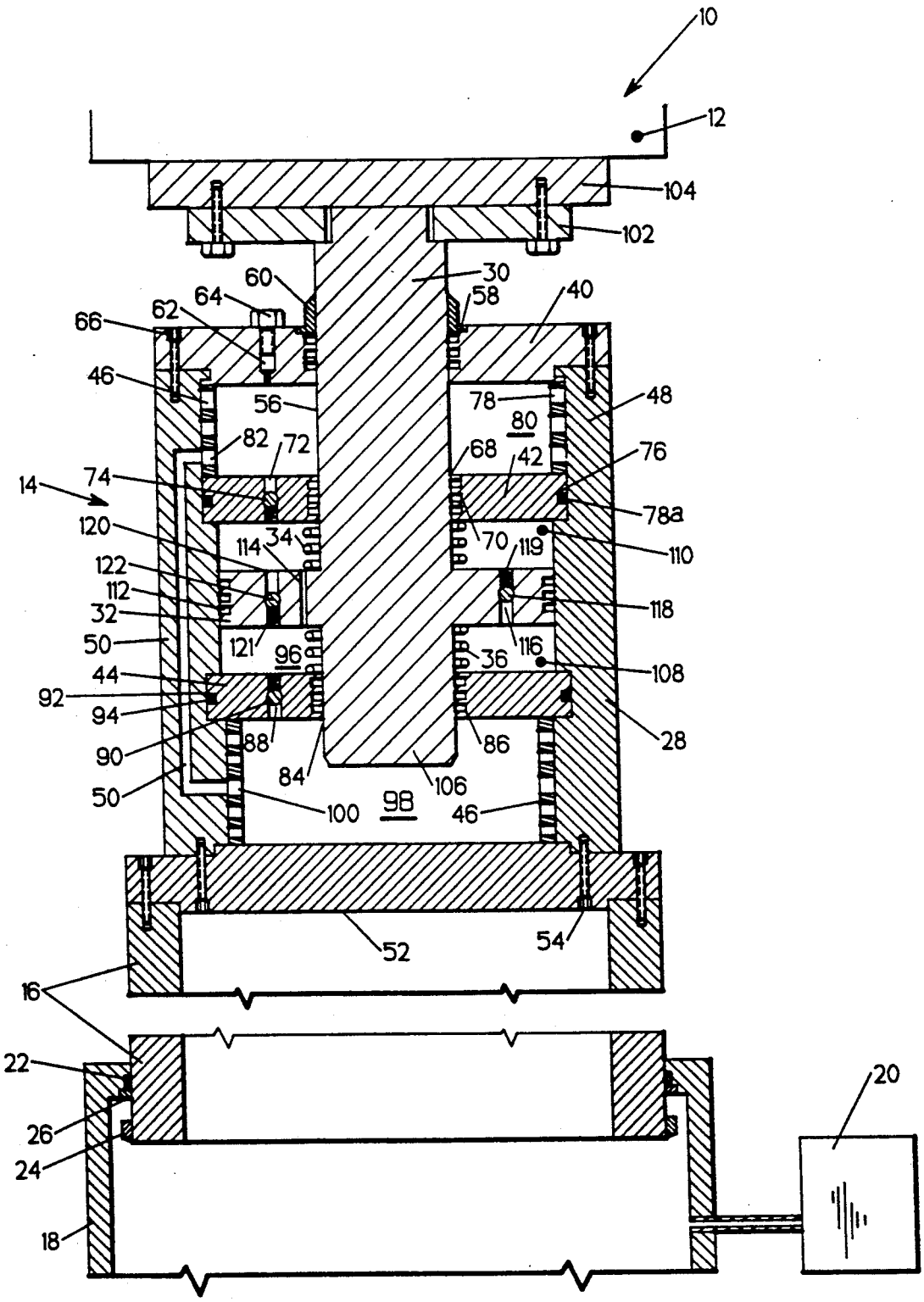
10
12
104
102
30
60
58
40
64
62
66
46
56
78
48
80
82
72
68
42
76
14
74
78a
120
34
70
119
110
114
122
112
118
32
121
96
116
50
36
108
44
92
94
28
88
86
90
84
106
50
100
98
46
52
54
16
22
20
26
24
18

HYDRAULIC CUSHIONRIDE ELEVATOR

TECHNICAL FIELD

This invention relates to hydraulic elevators and more particularly to a device for minimizing the effects of friction therein.

BACKGROUND ART

In a typical hydraulic elevator, a car is raised and lowered by a plunger/cylinder assembly located beneath the car. The assembly comprises a plunger that translates upwardly and downwardly within a cylinder. A seal is provided at an interface between the cylinder and plunger to prevent leakage of hydraulic fluid while allowing the pressure force of the fluid to act upon the plunger.

The seal should allow the plunger to translate without experiencing drag. However, elevators experience a phenomenon known as "stick-slip" in which the plunger sticks to the seal when the elevator car is stopped and suddenly slips when the sticking friction is broken. Upon start-up of the system, a pressure gradient in the hydraulic fluid urges the plunger to move until the sticking friction between the plunger and the seal is broken forcing the car to rise or fall suddenly. Stick-slip is usually experienced by elevator passengers as a sudden acceleration or bump at the beginning of elevator travel.

Several methods have been tried to reduce the effect of stick-slip. Among them are special materials, special surface finishes, and special seal section shapes. None have been totally effective.

Another problem hydraulic elevators encounter relates to stopping a car when it overruns terminal stopping devices and engages physical stops. Elevator codes require that there be a means to stop the upward travel of an elevator moving at contract speed when limit switches fail. Typically, the plunger has a stop ring welded on a bottom portion thereof and the cylinder has an internal ring or shoulder disposed within a top portion thereof. If the stop ring engages the internal ring abruptly, there is a great potential, because of the forces involved, that either ring could be damaged.

DISCLOSURE OF THE INVENTION

It is an object of the invention to minimize the probability that the plunger assembly is damaged in an emergency situation.

It is a further object of the invention to minimize the effect of stick-slip.

According to the invention, a mechanism is placed between the plunger and the elevator car to damp the effects of stick-slip encountered during elevator start-up and to minimize the probability of damage to a plunger/cylinder assembly if the elevator car is stopped in an emergency. The mechanism comprises a self-leveling hydraulic shock absorber that operates independently of any stick-slip between the plunger and cylinder.

These and other objects, features, and advantages of the present invention will become more apparent in light of the following detailed description of a best mode embodiment thereof, as illustrated in the accompanying drawings.

BRIEF DESCRIPTION OF THE DRAWINGS

The FIGURE is a perspective view, partially cut away, of an embodiment of the anti-stick-slip device of the invention.

BEST MODE FOR CARRYING OUT THE INVENTION

An hydraulic elevator system employing an embodiment of the invention is shown. The system 10 is comprised of an elevator car 12, a shock absorber 14, a plunger 16, a cylinder 18 and a machine 20 which supplies hydraulic fluid to the cylinder (as is known in the art). The shock absorber is designed so that it absorbs impulse energy from the plunger at the beginning of either an up or down run and then slowly transmit the energy to the car at a rate controlled by a damping ratio of the shock absorber. The shock absorber also minimizes the damage caused to the plunger or cylinder if an uprun emergency is experienced.

As is known in the art, a seal or packing 22 is disposed between the plunger 16 and the cylinder 18, the plunger has a stop ring 24, and the cylinder has a shoulder 26 for engaging the stop ring.

The shock absorber 14 comprises: a cylindrical housing 28, a piston rod 30, a piston head 32 integral with the piston rod, a first spring 34, and a second spring 36.

The housing 28 comprises: first, second, and third disc-shaped plates 40, 42, 44; and a two ring-shaped spacers 46. The housing has an internal area 48 of reduced diameter and a passageway 50 disposed therein which allows a flow of hydraulic fluid therethrough as will be discussed infra. The housing is attached to an end cap 52 of the plunger 16 by bolts 54 or the like.

The first plate 40 has a cylindrical bore 56 for receiving the piston rod 30. The bore has a plurality of concentric annular grooves 58 which act as a labyrinth seal in cooperation with the piston rod. A dynamic seal 60, as is known in the art, may be provided at the top of the bore to engage the piston rod. The seal prevents hydraulic fluid from leaking from, or dust and dirt from entering, the interior of the housing 28. The seal is a low pressure device which creates negligible frictional drag. The first plate has a first conduit 62, sealed by a plug 64, which is used to fill the interior of the body. The first plate is attached to a top of the body 38 by bolts 66 or the like.

The second plate 42 also has a cylindrical bore 68 for receiving the piston rod 30. Similarly, the bore has a plurality of concentric annular grooves 70 which act as a labyrinth seal in cooperation with the piston rod. The second plate has a second conduit 72 in which a first check valve 74 is disposed. The first check valve allows fluid to pass only downwardly through the conduit. The second plate has a annular groove 76 placed in a radially outward side portion therein. An O-ring 78A is placed in the groove 76 to prevent fluid from flowing around the second plate. The second plate is seated upon the area of reduced diameter 48 and is held in place by spacers 46. Such spacers fit loosely in the body and have radial holes 78 drilled therethrough to ensure that they are in pressure equilibrium.

The first plate 40, the second plate 42, and the housing 28 cooperate to define a first chamber 80. The passageway 50 communicates with the first chamber via first port 82. The first chamber accumulates fluid discharged through the labyrinth seal and through the passageway. Fluid may flow from, but not into, the first chamber 80 via the first check valve 74.

The third plate 44 also has a cylindrical bore 84 for receiving the piston rod 30. Similarly, the bore has a plurality of concentric annular grooves 86 which act as a labyrinth seal in cooperation with the piston rod. The third plate has a third conduit 88 in which a second check valve 90 is disposed. The second check valve allows fluid to pass only upwardly through the third conduit. The third plate has a annular groove 92 placed in a radially outward side portion therein. An O-ring 94 is placed in the groove to prevent fluid from flowing around the third plate. The third plate is seated against the area of reduced diameter 48 and is held in place by one of the spacers 46.

The second plate 42, the third plate 44, and the housing 28 cooperate to define a second chamber 96 in which the piston head 32 is disposed. The third plate, the end plate 52 of the plunger, and the housing cooperate to define a third chamber 98. The third chamber, which is normally full of fluid, collects any fluid which leaks past or through the second check valve 90. The passageway 50 communicates with the third chamber via second port 100.

The piston rod 30 extends through the bores 56, 68, 84 in the first, second and third plates 40, 42, 44 and attaches to the elevator car 12 via attachment flange 102 and the underside of the car 104. A bottom portion 106 of the piston rod extends into the third chamber 98.

The piston head 32 extends radially outwardly from the rod 30 within the second chamber 96 thereby dividing the second chamber into a lower section 108 and an upper section 110. The upper and lower sections have equal cross sectional areas such that all of the fluid displaced from one may be accommodated in the other so that the pressures in both under steady state conditions are equal and any differential steady load is carried by the springs 34, 36.

The piston head 32 has annular grooves 112 in its radially outward walls which act as a labyrinth seal and help to center the piston head. Fluid may flow through the labyrinth seal as will be discussed infra. The flow through the labyrinth may be supplemented by a capillary 114 through the piston head if required. The piston head has a fourth conduit 116 in which a third check valve 118 is disposed. The third check valve acts as a relief valve to allow fluid to pass upwardly through the fourth conduit only when the pressure differential across the valve reaches a value sufficient to overcome the preloaded spring 119 within the valve. The piston head has a fifth conduit 120 in which a fourth check valve 122 is disposed. The fourth check valve, similarly to the third check valve, acts as a relief valve to allow fluid to pass downwardly through the fifth conduit only when the pressure differential across the valve reaches a value sufficient to overcome the preloaded spring 121 within the valve.

The first spring 34 is disposed between the second plate 42 and the piston head 32. The second spring 36 is disposed between the third plate 44 and the piston head. The springs may be preloaded and may have different spring rates from each other. In the embodiment shown the second spring is stiffer than the first spring. The springs allow the shock absorber to return to an equilibrium position after absorbing shock.

At the start of an elevator up run, the plunger 16 breaks the friction of the stick-slip. An impulse causes the plunger to rise rapidly. Due to the inertia of the piston rod 30, the housing 28 rises up relative thereto. The second spring 36 resists this motion as does the fluid in the lower section of the second chamber. The pressure in the lower section 108 increases. As the piston rod enters the third chamber 98, fluid may be displaced into the first chamber 80 via the passageway 50. Similarly, when the rod starts to retract from the third chamber, fluid may pass through the passageway from the first chamber to the third chamber.

In order to absorb the energy and not transmit it to the car, the third check valve 118 opens to allow fluid to flow from the lower section 108 to the upper section 110. The action of the moving fluid and the compression of the second spring 108 and spring 119 act to absorb the sudden impulse and not transmit the energy immediately to the car. The fluid passage through the third check valve dissipates the energy of the impulse. In addition, the fluid may flow through the labyrinth between the piston head and the housing and the capillary 114.

After compression, the force of the second spring 36 restores the system to equilibrium. As the plunger 16 and car 12 move upward relative to the housing 28, fluid passes from the upper section to the lower section at a controlled rate via the capillary 114, or the labyrinth described earlier. Thus the impulse is absorbed and the car moves slowly upward relative to the housing. Once the upper and lower sections of the second chamber are in equilibrium, the piston and the car will move as one unit.

On a down run, if the pressure in the cylinder 18 is reduced lower than the pressure needed to support the elevator car and passengers before sticking friction is broken, the car can fall suddenly until the load pressure equalizes with the fluid pressure force of the fluid in the cylinder. When the pressure equalizes, the plunger 18 can suddenly slow thereby shocking the car. While the hydraulic fluid in the system absorbs some of this shock, the shock absorber 14 of the invention is more effective as follows.

As the plunger 16 suddenly slows, the housing 28 rises relative to the piston rod 30, as described above. This action is absorbed by the fluid passing from the lower section 108 to the upper section 110 through the third check valve 18, and the compression in the second spring 36 and spring 119. After compression, the second spring expands to its normal length. The fluid in the upper section returns to the lower section by passing through the labyrinth or the capillary 114 in the plunger and slowly moving the plunger in downward direction as described above.

In another embodiment of this invention, the third and fourth check valves may be mounted in the wall of the housing. These check valves would be connected to chambers through suitable passages. In a further embodiment of this invention, chambers may be connected to external accumulators, containing pressurized gas isolated from the fluid by a bag, diaphragm, plunger, or similar device. These accumulators would serve as springs in addition to or instead of the first and second springs.

Another function of this invention is to minimize the effect of the stop ring 24 impact on the cylinder shoulder 26 or seal 22 during an up-run emergency. Typically, when all other final stopping mechanisms (not shown) have failed, the stop ring on the plunger impacts the cylinder head packing as a final method of containing the travel of the plunger. If the car is rigidly attached to the plunger, the stop ring impacts the seal or the shoulder with the full momentum of the car and the plunger mass. In this invention, only the momentum from the mass of the plunger will impact the cylinder head at full speed, thus reducing the chance for impact damage. Because of the shock absorber 14, the elevator would tend to continue its upward movement and try to pull the plunger up as well. The upward motion of the elevator is resisted by the first spring 34 and the fluid in the upper section 110 which increases in pressure as a result. When the pressure reaches a predetermined limit, the fourth check valve 122 opens and allow the fluid to flow from the upper section to the lower section, thereby dissipating the impact energy. As the fluid volume reduces, the first spring 34 compresses and resists piston head 32 motion. The car's upward movement will slow down very rapidly since it is now being acted upon by both gravity and the restoring force of the spring. The fluid flow through the fourth check valve 122 (and the capillary 114 and the labyrinth between the piston head and the housing) dissipates some of the impact energy.

This type of car/plunger connection will provide a much more controlled stop than designs presently available and will minimize any impact damage to the cylinder head and associated repair costs. Should any fluid leak past the seal 60, if provided, or labyrinth during this emergency slowdown, it can easily be replaced via the first conduit 62 by temporarily removing access plug 64. The shock absorber of the invention also has the advantage of no experiencing stick-slip itself because of the low friction seal 60 and because of the controlled leakage of the labyrinths within the housing.

Although the invention has been shown and described with respect to a best mode embodiment thereof, it should be understood by those skilled in the art that the foregoing and various other changes, omissions and additions and the form and detail thereof may be made therein without departing from the spirit and scope of the invention.

We claim:

1. An hydraulic elevator comprising:

a cylinder;

a plunger mounted for translation in a first and second direction within said cylinder;

a platform; and a shock absorption means connecting said plunger to said platform, said shock absorber means isolating said platform from sudden relative motion between said cylinder and said plunger, wherein said shock absorption means comprises a housing connected to one of said plunger or said platform, a piston connected to the other of said platform or said plunger, said piston mounted for translation within said housing, and means reacting to motion of said piston for dissipating energy caused by sudden relative motion between said piston and said housing.

2. The hydraulic elevator of claim 1 wherein said means reacting to said motion of said piston comprises:

a head attaching to said piston, said head dividing said housing into two chambers, and spring means disposed in each of said chambers for resisting motion of said head relative to said housing.

3. The hydraulic elevator of claim 1 wherein said means reacting to said motion of said piston comprises:

a head attaching to said piston, said head dividing said housing into two chambers, hydraulic fluid disposed in each of said chambers, and means for damping motion of said piston head by restricting flow of said fluid from one of said chambers as said piston head compresses said chamber.

4. The hydraulic elevator of claim 3 wherein said means for damping motion of said piston head comprises:

a relief valve disposed in said piston head.

5. The hydraulic elevator of claim 3 further comprising:

means for accumulating hydraulic fluid displaced by motion of said piston.

6. The hydraulic elevator of claim 1 wherein said means reacting to said motion of said piston comprises:

a head attaching to said piston, said head dividing said housing into a first and second chamber, spring means disposed in each of said chambers for resisting motion of said head relative to said housing, hydraulic fluid disposed in each of said chambers, and means for damping motion of said piston head by restricting flow of said fluid from one of said chambers as said piston head compresses said chamber.

7. The hydraulic elevator of claim 6 wherein said means for damping motion of said piston head comprises:

a relief valve disposed in said piston head.

8. The hydraulic elevator of claim 6 further comprising:

means for accumulating hydraulic fluid displaced by motion of said piston.

9. The hydraulic elevator of claim 8 wherein said means for accumulating said hydraulic fluid comprises:

a third chamber within said housing and adjacent one of said first and second chambers, said piston translating within said third chamber, a channel in said housing communicating with said third chamber, and a fourth chamber communicating with said channel such that fluid may flow into and out of said chamber through said channel from and to said third chamber.

10. An hydraulic elevator comprising:

a cylinder;

a plunger mounted for translation in a first and second direction within said cylinder;

a platform; and a shock absorption means connecting said plunger to said platform, said shock absorber means isolating said platform from sudden relative motion between said cylinder and said plunger, wherein said shock absorption means includes means for reacting to sudden relative motion between said plunger and said cylinder in both of said first and second directions of translation.

11. A shock absorber for mounting between an elevator platform and the means for displacing the elevator platform, comprising:

a housing;

a piston rod, having a piston head, mounted for reciprocating translation within said housing;

a first biasing means, for biasing said piston head in a first direction of translation within said housing;

a second biasing means, for biasing said piston head in a second direction of translation, opposite said first direction, within said housing; and a viscous damping means, having a viscous fluid, for damping the translation of said piston rod within said housing.

12. A shock absorber according to claim 11, wherein said housing further comprises a plurality of chambers.

13. A shock absorber according to claim 12, wherein said viscous damping means further comprises means for damping motion of said piston head by restricting flow of said fluid from one of said chambers as said piston head compresses said chamber.

* * * * *